United States Patent [19]

Bargfrede et al.

[11] Patent Number: 4,967,850

[45] Date of Patent: Nov. 6, 1990

[54] COMBINED TOOTH RETRACTOR AND BLADE LATCHING MECHANISM

[75] Inventors: Brent C. Bargfrede, Dunlap; Robert J. Purcell, Washington, both of Ill.

[73] Assignee: Caterpillar Inc., Peoria, Ill.

[21] Appl. No.: 430,552

[22] Filed: Nov. 2, 1989

[51] Int. Cl.[5] ..... F41H 11/16; E02F 3/76

[52] U.S. Cl. ..... 172/197; 89/1.13; 172/777; 172/466

[58] Field of Search ..... 172/777, 778, 810, 811, 172/817, 828, 466, 197; 89/1.13; 37/2 R

[56] References Cited

U.S. PATENT DOCUMENTS

| | | | |
|---|---|---|---|
| 2,042,196 | 5/1936 | Senz | 37/145 |
| 2,899,760 | 8/1959 | Armington | 172/777 |
| 2,993,285 | 7/1961 | Hoxie | 37/145 |
| 3,559,749 | 2/1971 | Fryrear | 172/802 |
| 3,834,465 | 9/1974 | Collins | 172/197 |
| 4,227,852 | 10/1980 | Schmitz et al. | 414/694 |
| 4,370,090 | 1/1983 | Shumaker et al. | 414/694 |
| 4,462,172 | 7/1984 | Caron | 172/817 |
| 4,467,694 | 8/1984 | Azulai | 172/828 |
| 4,512,090 | 4/1985 | Billings | 172/777 |
| 4,660,650 | 4/1987 | Wiebe | 172/466 |
| 4,690,030 | 9/1987 | Bar-Nefy | 172/828 |

*Primary Examiner*—Richard J. Johnson
*Attorney, Agent, or Firm*—J. W. Burrows

[57] ABSTRACT

Blade assemblies having a plurality of teeth extending therefrom are useful for working soil and/or for removing objects buried under the surface of the ground. However, having a plurality of teeth extending below the blade assembly can be detrimental since ground clearance is reduced or if the blade assembly inadvertently lowers during movement of the vehicle from one job site to another. In the subject arrangement, a blade assembly is provided having a plurality of teeth extending therefrom. The plurality of teeth are retractable in response to movement of a mechanism within the blade assembly. Upon raising the blade assembly to its carry position with subsequent retraction of the plurality of teeth, a mounting bar assembly which is associated with the plurality of teeth is moved into a recessed pocket of a latching flange. The latching flange is attached to a vehicle by a frame assembly. This arrangement ensures that the blade assembly is maintained in its carry position by the retraction of the plurality of teeth. Furthermore, this arrangement retracts the plurality of teeth to a position generally within the blade assembly for added ground clearance.

10 Claims, 5 Drawing Sheets

COMBINED TOOTH RETRACTOR AND BLADE LATCHING MECHANISM

TECHNICAL FIELD

This invention relates generally to an arrangement to positively latch a blade assembly in the carry position and more specifically to a latching mechanism used in conjunction with the blade assembly having a retractable tooth assembly.

BACKGROUND ART

Latching mechanisms are commonly used to secure a movable member to a stationary member in order to control unwanted movement. One example of such use is illustrated in U.S. Pat. No. 4,227,852 which issued on Oct. 14, 1980, to F. A. Schmitz et al. It teaches a latch mechanism which secures a boom assembly of the backhoe to the frame when the boom is raised to its maximum position. Upon reaching its maximum raised position, the boom can be latched to the frame, provided the stick is in its fully retracted position. Another example is illustrated in U.S. Pat. No. 4,370,090 which issued Jan. 25, 1983, to J. F. Shumaker et al. It also teaches a latch mechanism for securing a boom to the frame when the boom is raised to its maximum position. The latching of the boom can only be affected if the stick is in its fully retracted position.

Retractable teeth assemblies are commonly used in blade assemblies to control the extent of extension of the teeth on the blade assemblies and to provide ample ground clearance for better mobility. Normally in these arrangements, the height of the blade assembly is controlled by a double acting cylinder and the extension of the teeth is controlled by another double acting hydraulic cylinder. In these arrangements, there normally is no interrelationship between the raising or lowering of the blade and the extending or retracting of the retractable teeth. One example of such an arrangement is illustrated in U.S. Pat. No. 3,559,749 which issued on Feb. 2, 1971, to M. D. Fryrear et al. It teaches a linkage arrangement for extending and retracting a cutting edge of a blade assembly. Another example is set forth in U.S. Pat. No. 2,042,196 which issued on May 26, 1936, to N. H. Senz. It teaches an arrangement for extending and retracting a plurality of teeth between fully retracted and fully extended positions. The degree of extension or retraction is controlled, depending on soil conditions, by the operator. A further example is illustrated in U.S. Pat. No. 2,993,285 which issued July 25, 1961, to H. G. Hoxie. It teaches a scarifier arrangement for use on the ends of a bulldozer blade. Depending on soil conditions, the operator can selectively extend or retract either of the scarifier teeth. U.S. Pat. No. 3,834,465 which issued Sept. 10, 1974, to J. C. Collins teaches a scarifier assembly which operates in conjunction with a scraper bowl to break up the soil which makes it easier for loading the soil into the scraper bowl. The scarifier assembly has a mechanical latch mechanism for locking the scarifier in its fully extended position once the scarifier has been moved to its fully extended position.

The present invention is directed to overcoming one or more of the problems as set forth above.

DISCLOSURE OF THE INVENTION

In one aspect of the present invention, a combined tooth retractor and blade latching mechanism is provided and adapted for use on a vehicle. The combined tooth retractor and blade latching mechanism includes a frame assembly having first, second, and third pin connection joints and a latching flange. The combined tooth retractor and blade latching mechanism also includes a blade assembly having a moldboard, a top mounting portion, a bottom mounting portion, a retractable tooth assembly, and means for extending and retracting the tooth assembly. A linkage mechanism is also provided and has a push arm connected between the first pin connection joint of the frame assembly and the bottom mounting portion of the blade. The linkage mechanism also has a tilt arm connected between the second pin connection joint of the frame assembly and the top mounting portion of the blade. The linkage mechanism further includes a lift mechanism connected between the push arm and the third pin connection joint of the frame assembly and operative to raise and lower the blade assembly. A means for latching the blade assembly to the frame assembly is provided in the combined tooth retractor and blade latching mechanism and is operative in response to raising of the blade assembly to a predetermined height with subsequent retraction of the tooth assembly.

The present invention provides a combined tooth retractor and blade latching mechanism that allows a blade assembly to be positively secured to the frame assembly of the vehicle when the vehicle is being moved from one work site to another. The interrelationship between the tooth retractor and the blade latching mechanism is beneficial since, upon raising the blade to a predetermined height followed by retraction of the tooth assembly, the automatic locking of the blade in the carry or transport position is provided. During the carry or transport position of the blade, any inadvertent movement of the "lower" control lever will not allow the blade assembly to lower since the latch mechanism secures the blade in its carry position. It is necessary to extend the tooth assembly in order to unlatch the blade assembly so that the blade can be lowered to the operative position.

BEST MODE FOR CARRYING OUT THE INVENTION

Figure 1:
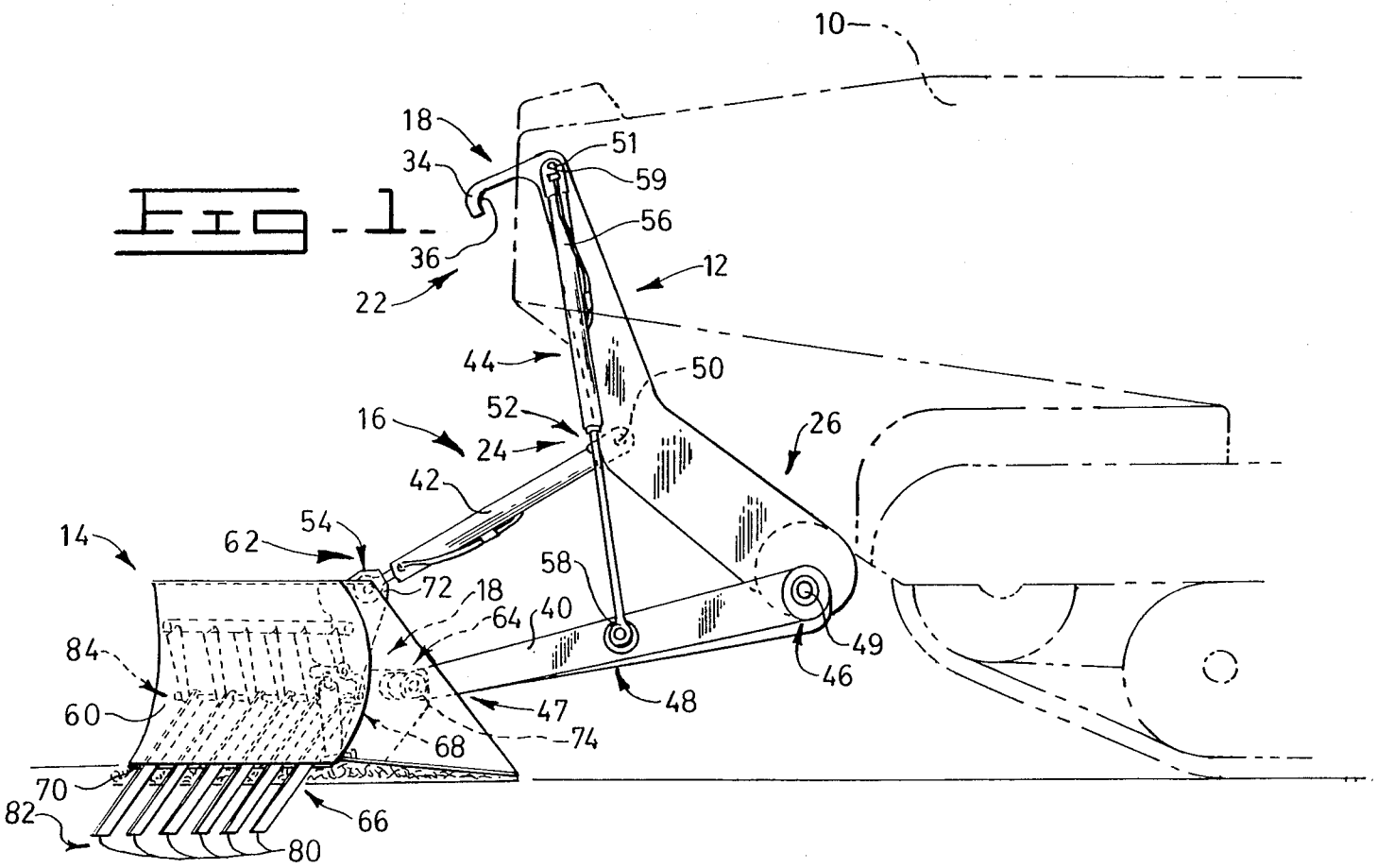
FIG. 1 is a side view of a blade assembly in the operative position.
Figure 2:
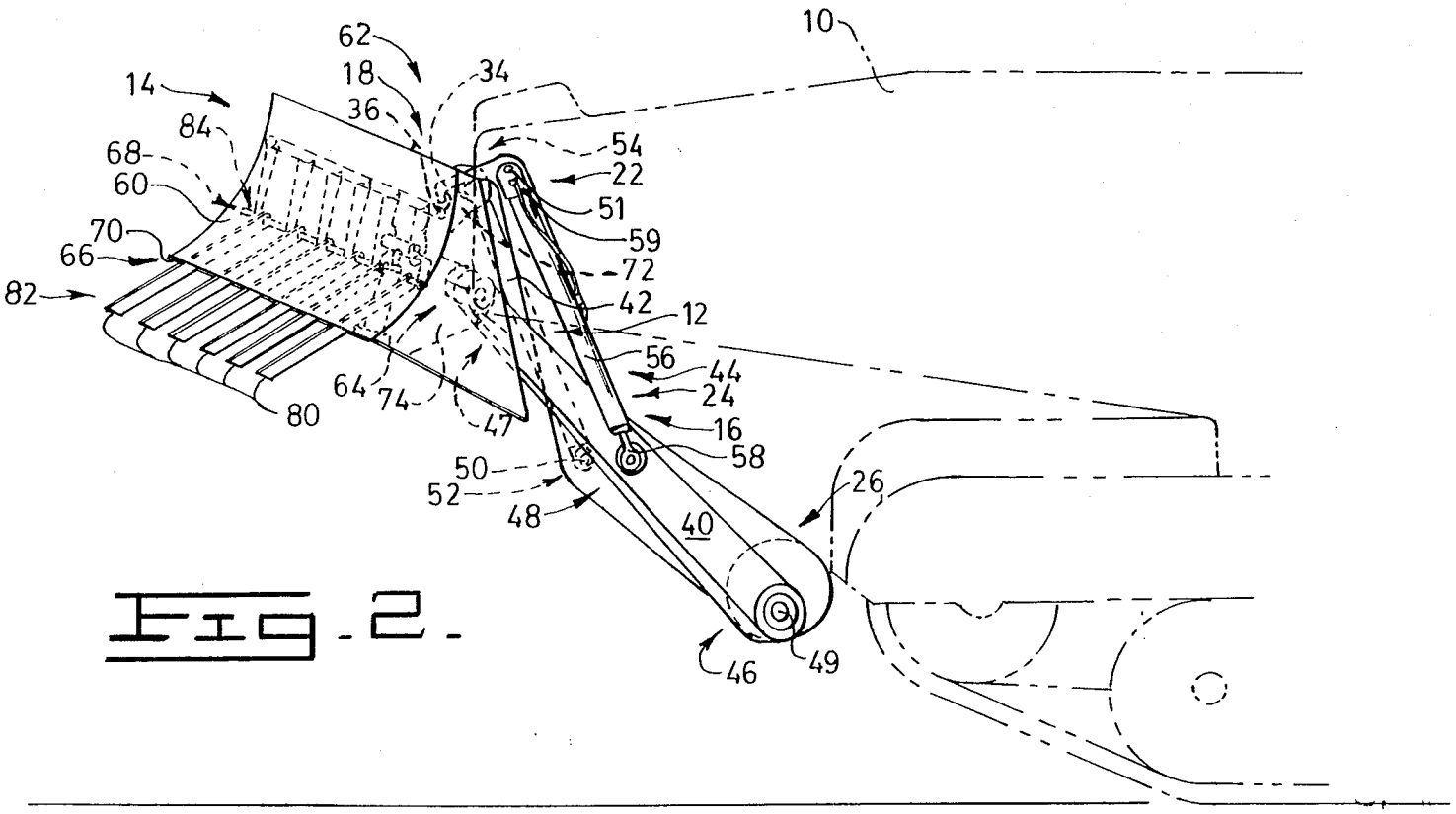
FIG. 2 is a side view of the blade assembly in the raised position and has a plurality of teeth in an extended position.
Figure 3:
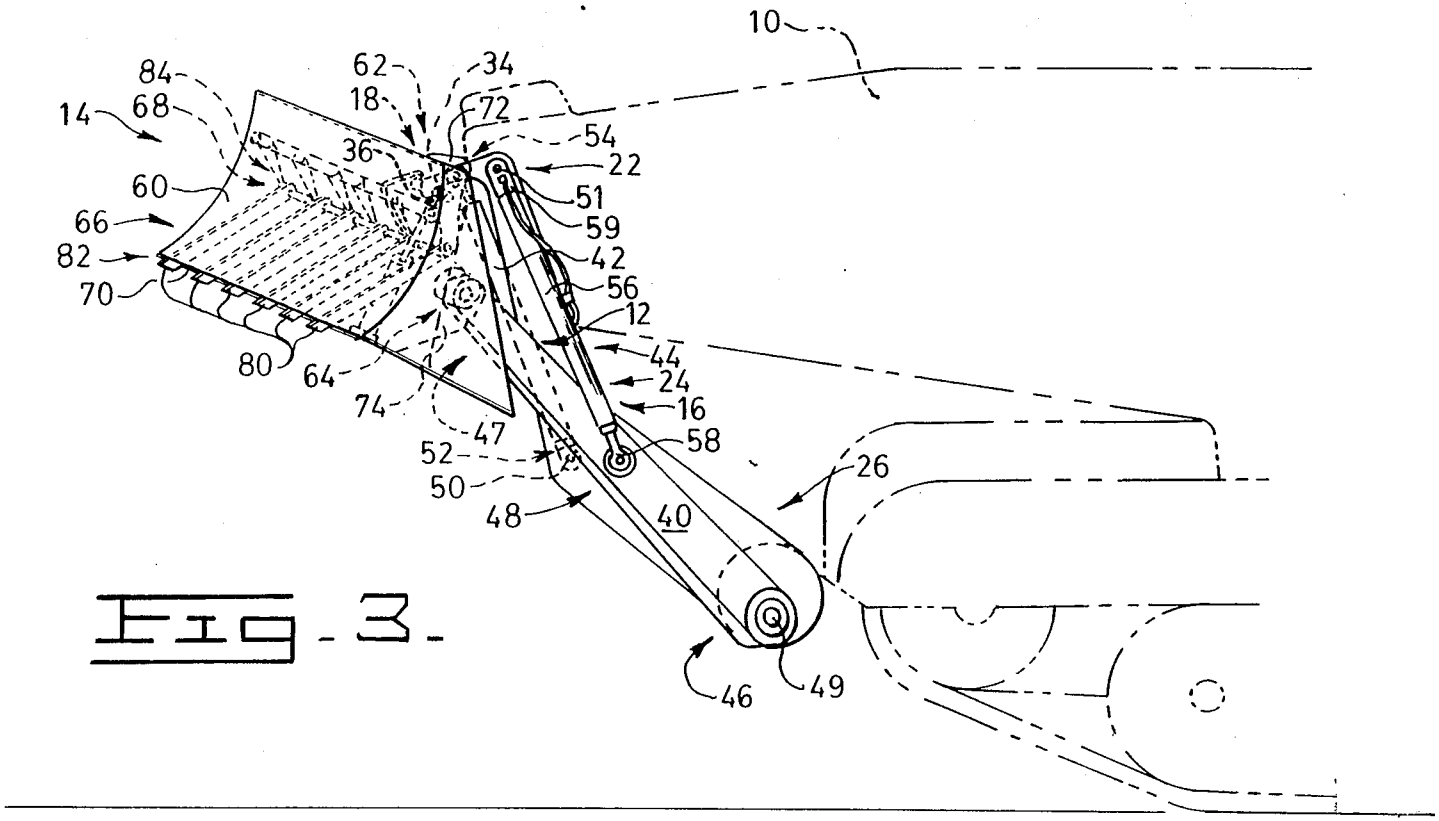
FIG. 3 is a side view of the blade assembly of FIG. 2 with the plurality of teeth in a retracted position and a latch mechanism engaged.

Referring to the drawings, and more particularly to FIGS. 1, 2, and 3, a vehicle 10 is provided having a frame assembly !2 attached thereto, a blade assembly 14 attached to the frame assembly 12 by a linkage mechanism 16, and a means 18 for latching the blade assembly 14 to the frame assembly 12. The frame assembly 12 has an upper portion 22, a central portion 24, and a lower portion 26. A latching flange 34 is disposed in the top portion 22 of the frame assembly 12 and defines a recessed pocket 36 therein. It is recognized that the latching flange 34, as shown, is an integral part of the frame assembly 12, but it could be secured thereto by welding, bolting, etc.

The linkage mechanism 16 includes a push arm 40, a tilt arm 42, and a lift mechanism 44. The push arm 40 has a first end portion 46, a second end portion 47, and a central portion 48. The first end portion 46 of the push arm 40 is adapted for pivotal connection with the bottom portion 26 of the frame assembly 12 by a first pin connection 49. The tilt arm 42 has a first end portion 52 and a second end portion 54. The first end portion 52 of the tilt arm 42 is adapted for pivotal connection with the central portion 24 of the frame assembly 12 by a second pin connection 50. The lift mechanism 44, as illustrated, is a hydraulic cylinder 56 having a rod end 58 and a head end 59. The rod end 58 of the hydraulic cylinder 56 is adapted for pivotal connection with the central portion 48 of the push arm 40. The head end 59 of the hydraulic cylinder 56 is adapted for pivotal connection with the top portion 22 of the frame assembly 12 by a third pin connection 51. The hydraulic cylinder 56 is connectable in a known manner to a hydraulic system (not shown) for controlling the raising and lowering of the blade assembly 14.

The blade assembly 14 includes a moldboard 60, a top mounting portion 62, a bottom mounting portion 64, a retractable tooth assembly 66, and a means 68 for extending and retracting the tooth assembly 66. The moldboard 60 has a bottom edge 70 and is of a conventional profile, as shown. A first mounting bracket 72 is disposed in the top mounting portion 62 of the blade assembly 14 and is adaptable for universally coupling the second end portion 54 of the tilt arm 42 thereto. A second mounting bracket 74 is disposed in the bottom mounting portion 64 of the blade assembly and adaptable for pivotal connection with the second end portion 48 of the push arm 40.

The retractable tooth assembly 66 includes a plurality of teeth 80. Each tooth of the plurality of teeth 80 has a ground engaging end portion 82 and a mounting end portion 84. As better illustrated in FIG. 5, a slot 86 is defined in the mounting end portion 84 of each tooth of the plurality of teeth 80. The plurality of teeth 80 of the retractable tooth assembly 66 is moveable between a first, retracted position as illustrated in FIG. 1 to a second, extended position as illustrated in FIG. 3. When in the retracted position, the plurality of teeth are generally located behind the moldboard 60 and has the ground engaging end portions 82 thereof generally adjacent the bottom edge 70 of the moldboard 60.

The blade assembly 14 is moveable between an operative position as illustrated in FIG. 1 and a raised transport or carry position as illustrated in FIGS. 2 and 3. FIG. 2 illustrates the blade assembly 14 in the raised or up position with the plurality of teeth 80 remaining in the second, extended position. FIG. 3, however, illustrates the plurality of teeth 80 in their first, retracted position. As will be described hereinafter, with the plurality of teeth 80 in their retracted position, the blade assembly 14 is latched to the frame assembly 12.

Figure 4:
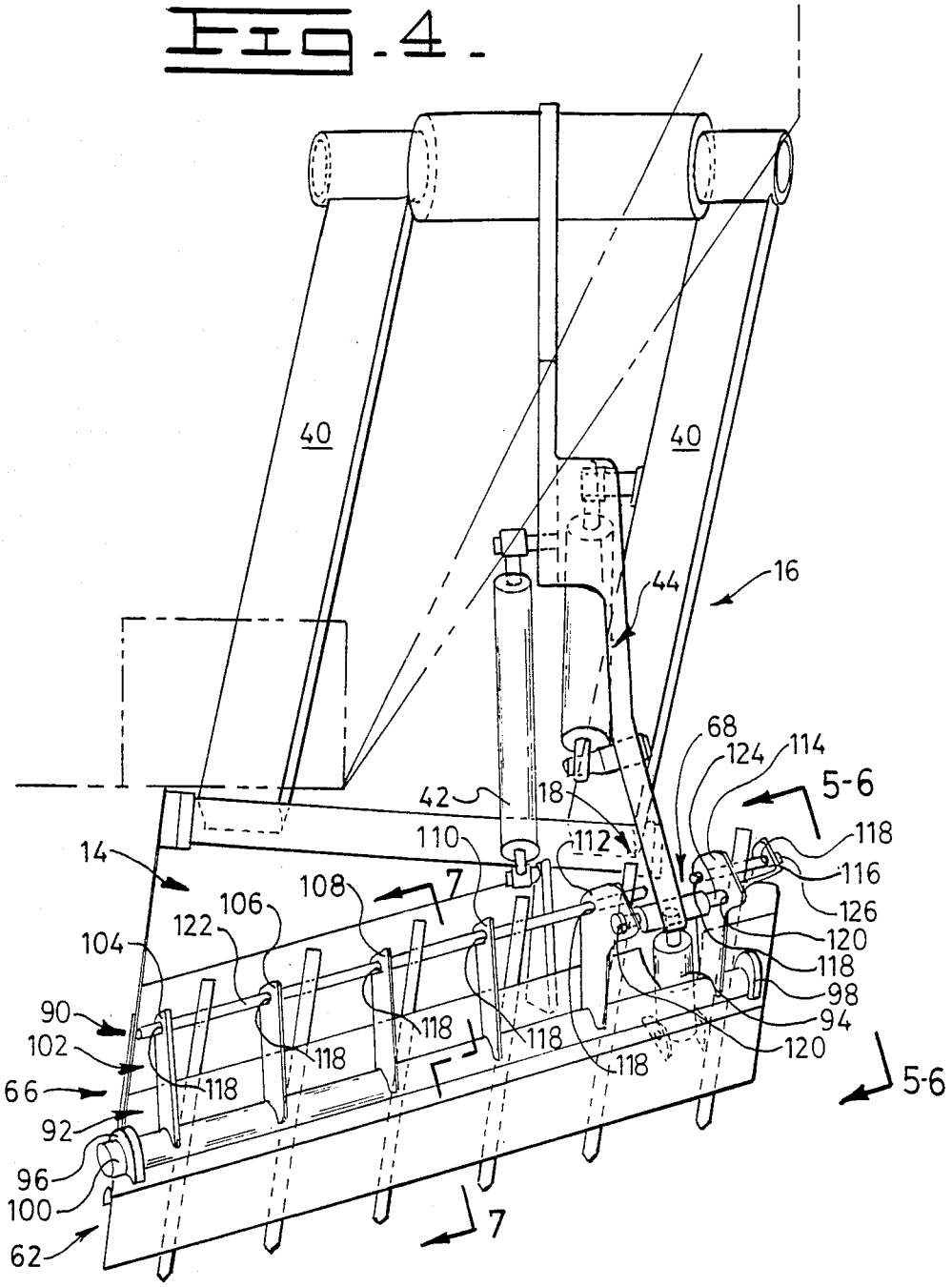
FIG. 4 is a top view of the blade assembly shown in FIG. 3.

Referring now to ,FIG. 4, the means 68 for extending and retracting the tooth assembly 66 includes a mounting bar assembly 90, a pivotal link mechanism 92, and a double acting cylinder 94. The pivotal link mechanism 92 includes first and second mounting brackets 96,98 disposed on the top mounting portion 62 of the blade assembly 14 and a rotatable beam 100 pivotally disposed in the first and second mounting brackets 96,98. The rotatable beam 100 is operative to rotate relative to the first and second mounting brackets 96,98. A plurality of links 102 are secured to the rotatable beam 100 at spaced apart locations thereon and extend generally perpendicular therefrom. The plurality of links 102 includes first, second, third, fourth, fifth, and sixth links 104,106,108,110,112,114. A flange 116 is connected to one side of the sixth link 114 and is shaped in a generally L-shape in order to have a portion thereof spaced from and parallel with the sixth link 114. Each link of the plurality of links 102 and the flange 116 have a hole 118 defined therein. The respective holes 118 are located near the end of the respective links spaced from the end connected to the rotatable beam 100. The holes 118 are in axial alignment with each other and oriented generally parallel with the rotatable beam 100. Each of the fifth and sixth links 112,114 defines a hole 120 therein spaced from the hole 118. The holes 120 are in axial alignment With each other and also generally parallel with the rotatable beam 100.

The mounting bar assembly 90 has a first rod 122, a second rod 124, and a third rod 126. The first rod 122 is disposed in the holes 118 of the first, second, third, fourth, and fifth links 104,106,108,110,112. The second rod 124 is disposed in the holes 120 between the fifth and sixth links 112,114. The third bar 126 is disposed in the holes 118 of the sixth link 114 and the flange 116. It is recognized that the first, second, and third rods 122,124,126 could be replaced with a single continuous rod without departing from the essence of this invention. It is further recognized, that using one continuous rod would result in the elimination of the second rod 124 and the respective holes 120.

The double acting cylinder 94 is connected at one end to the bottom mounting portion 64 of the blade assembly 14 while the opposite end of the double acting cylinder 94 is connected to the second rod 124 of the mounting bar assembly 90. The double acting cylinder 94 is operative to move the mounting bar assembly 90 between first and second positions.

During assembly of the blade assembly 14, the respective slot 86 of each of the plurality of teeth 80 receives the respective first and third rods 122,126. At the first position of the double acting cylinder 94 the plurality of teeth 80 are in their retracted position and the blade assembly 14 is latched to the frame assembly 12 as illustrated in FIG. 3. At the second position of the double acting cylinder 94, the plurality of teeth 80 are in their extended position and the blade assembly 14 is unlatched from the frame assembly 12 .

Figure 5:
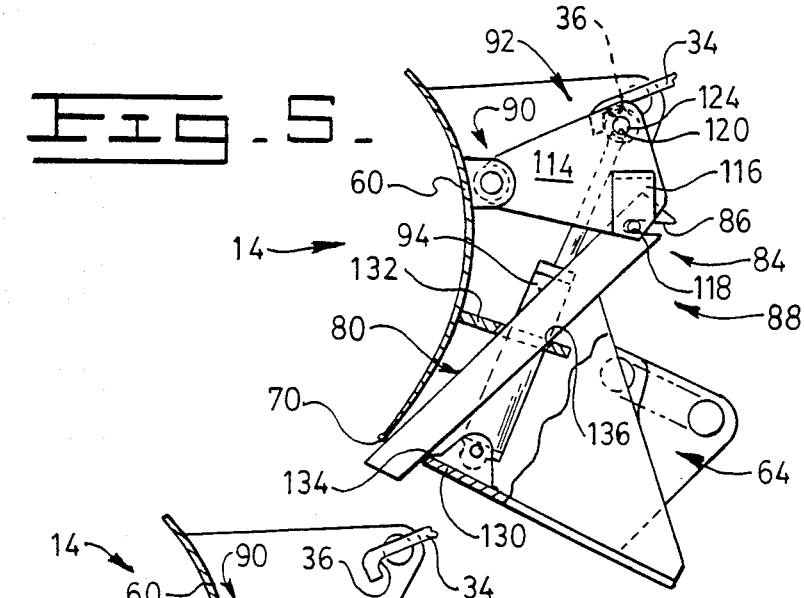
FIG. 5 is an end view of the blade assembly of FIG. 4 taken perpendicular to the front of the blade assembly with portions thereof broken away.

Referring now to FIG. 5, portions of the extending and retracting means 68 are more clearly illustrated. The mounting bar assembly 90 in combination with the pivotal link mechanism 92 retracts the plurality of teeth 80 to their fully retracted position in response to the double acting cylinder 94 being moved to its first position. With the double acting cylinder 94 in its first position the second rod 124 is located within the recessed pocket 36 of the flange member 34. With the second rod 124 located in the recessed pocket 36, the blade assembly 14 is maintained in its carry position.

The blade assembly 14 includes a first support guide 130 integrally formed with the bottom 64 and connected adjacent the bottom mounting portion: edge 70 of the moldboard 60. A second support guide 132 is integral with the bottom mounting portion 64 adjacent the moldboard 60 and vertically spaced above the first support guide 130. The first support guide 130 has a plurality of support guide openings 134 defined therein axially spaced from each other and located behind the bottom edge 70 of the moldboard 60. A second plurality of support guide openings 136 are defined in the second support guide 132. Each guide opening of the second plurality of support guide openings 136 is located vertically above and rearwardly disposed with respect to respective ones of the first plurality of support guide openings 134 in the first support guide 130. Each tooth of the plurality of teeth 80 is disposed in corresponding support guide openings 134,136 of the first and second support guides 130,132.

Figure 6:
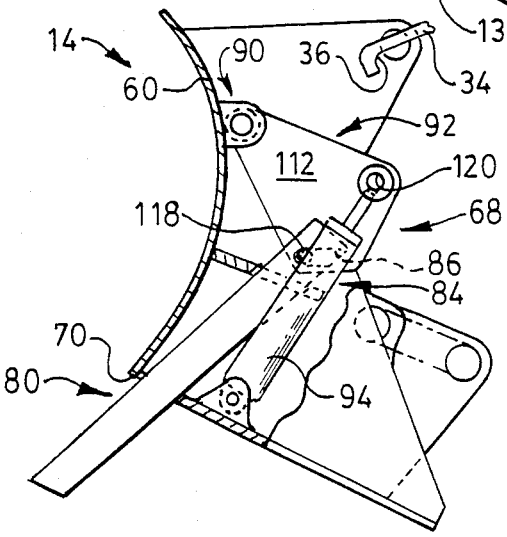
FIG. 6 is a side view similar to FIG. 5 but with the plurality of teeth in their extended position.

FIG. 6 illustrates the blade assembly 14 in its carry position with the plurality of teeth 80 in their extended position. In the extended position thereof the blade assembly 14 is unlatched from the frame assembly 12. The link 114 and its associated flange 116 are shown in FIG. 5 while the link 112 is shown in FIG. 6. These Figures better illustrate the location of the holes 118,120 therein.

Figure 7:
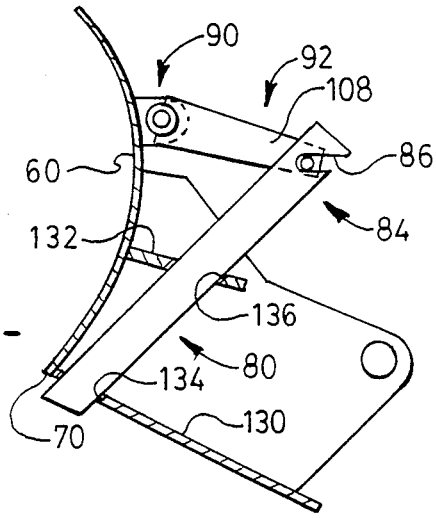
FIG. 7 is a sectional view taken from FIG. 4 which better illustrates a portion thereof.

FIG. 7 more clearly illustrates the third link 108 which is of the same construction as the first, second, and fourth links 104,106,110.

The latching flange 34 along with its recessed pocket 36, and the means 68 for extending and retracting the tooth assembly collectively make up the means 18 for latching the blade assembly 14 to the frame assembly 12. As previously set forth, the frame assembly 12 is attached to the vehicle 10. However, it is recognized that the frame assembly of the vehicle 10 could be effectively utilized in place of the frame assembly 14 set forth above without departing from the essence of the invention. Furthermore, the blade assembly 14 is illustrated only on one side of the vehicle 10. However, it is recognized that the blade assembly 14 could extend across the entire front of the vehicle or be a mirror image of the blade assembly 14 and mounted on the opposite side of the vehicle 10 without departing from the essence of the invention.

INDUSTRIAL APPLICABILITY

With reference to the drawings, during operation, as illustrated in FIG. 1, the blade assembly 14 is in working engagement with the ground and the plurality of teeth 80 are in their extended position for penetrating and working the ground below the surface thereof. The lift mechanism 44 is used to raise the blade assembly 14 and to the allow the blade assembly 14 to be lowered while the tilt arm 42 is utilized to maintain the blade assembly 14 at a particular pitch angle with respect to the ground.

Upon completion of working of the soil, the blade assembly 14 is raised, by the hydraulic cylinder 56, to its transport or carry position, as illustrated in FIG. 2. As further illustrated in FIG. 2, the plurality of teeth 80 remain in their extended position. In order to provide assurance that the blade assembly 14 remains in the carry position, the double acting cylinder 94 is extended to its first position to move the second rod 124 into the recessed pocket 36 of the latching flange 34. Once the second rod 124 is in the recessed pocket 36, the blade assembly 14 cannot be lowered. This is true since, due to the arc of the push arm 40 relative to the vehicle 10, the blade assembly 14 must simultaneously move outwardly and downwardly. The latching flange 34 prohibits outward movement of the blade assembly 14. Consequently, the blade assembly 14 is positively held in the carry position as long as the plurality of teeth 80 remain in their retracted position. Furthermore, the blade assembly 14 is positively held in the carry position without any concern of the blade assembly 14 suddenly dropping to the ground, even if the operator inadvertently moves the "lower" lever of the blade control or the hydraulic system suddenly fails.

When the operator wants to lower the blade assembly 14 to the operative position, he must first extend the plurality of teeth 80 which effectively moves the second rod 124 from the recessed pocket 36. Subsequently, the operator moves the "lower" lever, thus allowing the blade assembly 14 to move downwardly to the operative position.

Even though the lift mechanism 44 and the double acting cylinder 94 have been described as being totally independent of each other, it is well recognized that during the raise operation they could be interrelated. For example, sensors could be positioned such that once the blade assembly 14 reaches its maximum height or carry position, the double acting cylinder 94 automatically extends to retract the plurality of teeth 80 and simultaneously moves the second rod 124 into the recessed pocket 36 of the flange member 34.

The combined tooth retractor and blade latching mechanism as set forth herein provides a blade assembly 14 having a plurality of teeth 80 that can be utilized for working the soil and retracted when the blade assembly 14 is moved to the carry position, thus increasing the ground clearance. Upon retraction of the plurality of teeth 80, the blade assembly 14 is securely latched so that the blade assembly 14 cannot be inadvertently lowered. By having the assurance that the blade assembly 14 is secured in the carry position and cannot be inadvertently lowered, the vehicle 10 can travel at greater speeds without having the concern of inadvertently dropping the blade assembly 14 or striking other obstacles.

Other aspects, objects, and advantages of this invention can be obtained from a study of the drawings, the disclosure, and the appended claims.

We claim:

1. A combined tooth retractor and blade latching mechanism adapted for use on a vehicle, comprising:

a frame assembly having first, second, and third pin connection joints and a latching flange;

a blade assembly having a moldboard, a top mounting portion, a bottom mounting portion, a retractable tooth assembly, and means for extending and retracting the tooth assembly;

a linkage mechanism having a push arm connected between the first pin connection joint of the frame assembly and the bottom mounting portion of the blade assembly, a tilt arm connected between the second pin connection joint of the frame assembly and the top mounting portion of the blade assembly, and a lift mechanism connected between the push arm and the third pin connection joint of the frame assembly and operative to raise and lower the blade assembly; and means for latching the blade assembly to the frame assembly in response to raising of the blade assembly to a predetermined carry position and subsequent retraction of the tooth assembly.

2. The combined tooth retractor and blade latching mechanism, as set forth in claim 1, wherein the extending and retracting means includes a mounting bar assembly connected to the retractable tooth assembly, a pivotal link mechanism connected to the mounting bar assembly and the top mounting portion of the blade assembly.

3. The combined tooth retractor and blade latching mechanism, as set forth in claim 2, wherein the latching means includes a recessed pocket defined in the latching flange of the frame assembly, the recessed pocket is of a size sufficient to mate with the mounting bar assembly once the blade assembly has been raised to the predetermined carry position and the tooth assembly retracted.

4. The combined tooth retractor and blade latching mechanism, as set forth in claim 3, wherein the mounting bar assembly includes a first rod and the retractable tooth assembly includes a plurality of teeth and each tooth thereof being operatively attached to the first rod of the mounting bar assembly.

5. The combined tooth retractor and blade latching mechanism, as set forth in claim 4, wherein the bottom mounting portion of the blade assembly include first and second support guides vertically spaced from one another and secured to and located behind the moldboard, each of the support guides defining support guide openings therein of a size sufficient to slideably receive respective ones of the plurality of teeth.

6. The combined tooth retractor and blade latching mechanism, as set forth in claim 5, wherein the pivotal link mechanism includes a rotatable beam connected to the top mounting portion of the blade assembly and has a plurality of links secured to the rotatable beam, each link of the plurality of links connects with the mounting bar assembly at spaced apart locations.

7. The combined tooth retractor and blade latching mechanism as set forth in claim 6, wherein the plurality of links includes first, second, third, fourth, fifth, and sixth links and the first rod of the mounting bar assembly is connected between the first, second, third, fourth, and fifth links and a second rod is connected between the fifth and sixth links at a location spaced from the connection of the first rod with the fifth link, each tooth of the plurality of teeth defines a slot therein to slideably receive the first rod.

8. The combined tooth retractor and blade latching mechanism, as set forth in claim 6, wherein one end of the double acting cylinder is connected to the second rod and is operative to move the mounting bar assembly between first and second positions, at the first position of the mounting bar assembly the lower ends of the plurality of teeth are retracted to a position substantially adjacent the bottom edge of the moldboard, and at the second position thereof the lower ends of the plurality of teeth are fully extended below the moldboard.

9. The combined tooth retractor and blade latching mechanism, as set forth in claim 8, wherein the second rod of the mounting bar assembly is disposed in the recessed pocket of the latching flange when the blade assembly is in the carry position and the plurality of teeth are in their retracted position.

10. The combined tooth retractor and blade latching mechanism, as set forth in claim 9, wherein the sixth link of the plurality of links has a flange secured to one side thereof with a third rod connected therebetween in axial alignment with the first rod, the third rod is operative to mate with the slot in another one of the teeth of the plurality of teeth.

* * * * *

UNITED STATES PATENT AND TRADEMARK OFFICE

CERTIFICATE OF CORRECTION

PATENT NO. : 4,967,850

DATED : November 6, 1990

INVENTOR(S) : BRENT C. BARGFREDE and ROBERT J. PURCELL

It is certified that error appears in the above-identified patent and that said Letters Patent is hereby corrected as shown below:

Column 1, after title, please insert:

--This invention was made with Government support under contract number N61331-89-C-0011 awarded by Naval Coastal Systems Center. The Government has certain rights to this invention.--

Signed and Sealed this

Twenty-eighth Day of April, 1992

*Attest:*

HARRY F. MANBECK, JR.

*Attesting Officer*

*Commissioner of Patents and Trademarks*